US006161595A

United States Patent [19]

Shaw et al.

[11] Patent Number: 6,161,595

[45] Date of Patent: Dec. 19, 2000

[54] YARN TENSIONING DEVICE

[75] Inventors: Henry Shaw, Steenvoorde, France; Dirk Willemot, Rekkem; Ignace De Ro, Hollebeke, both of Belgium

[73] Assignee: Picanol N.V., Belgium

[21] Appl. No.: 09/402,448

[22] Filed: Jan. 7, 2000

[30] Foreign Application Priority Data

Apr. 7, 1997 [BE] Belgium ..... 9700316

[51] Int. Cl.[7] ..... B65H 59/22

[52] U.S. Cl. ..... 139/194; 242/419.3; 242/419.4; 188/65.1

[58] Field of Search ..... 139/194; 242/419.3, 242/419.4; 188/65.1

[56] References Cited

U.S. PATENT DOCUMENTS

| | | | |
|---|---|---|---|
| 3,633,711 | 1/1972 | Pfarrwaller | 139/450 |
| 5,002,098 | 3/1991 | Desmet et al. | 139/194 |
| 5,483,997 | 1/1996 | Corain et al. | 139/194 |
| 5,492,286 | 2/1996 | Motta | 139/450 |

*Primary Examiner*—Andy Falik
*Attorney, Agent, or Firm*—Bacon & Thomas PLLC

[57] ABSTRACT

A movable brake shoe (32) is mounted in a yarn brake (23). The yarn brake (33) includes two brake shoes (31, 32) arranged to brake a yarn (3) running between them. Actuating devices (33, 34) allow mutual compression of the brake shoes (31, 32). The movable brake shoe (32) is lamellar and tiltable about a tilt axis (49) which is located at a distance from and substantially parallel to the path of the yarn (3) to be braked.

12 Claims, 6 Drawing Sheets

YARN TENSIONING DEVICE

BACKGROUND OF THE INVENTION

1. Field of the Invention

The invention relates to a yarn brake comprising a movable sheet or plate-like lamellar brake shoe which can be urged by an actuating device against a fixed brake shoe in order to brake a yarn running between the brake shoes.

2. Description of the Related Art

Yarn brakes of the above type are described in the French patent documents A 1 161 662 and 2 300 734 and Italian patent document 593 034. As regards these designs, the movable brake shoe is pressed by its own weight, or by a magnetically adjustable force and/or by a pneumatically adjustable force against a fixed brake shoe. Such yarn brakes incur the drawback that they may damage the yarns, and/or rupture them, in particular when these yarns include nubs or thicknesses and/or other irregularities.

A yarn brake is known from the German patent document 21 30 670 which is fitted with two pairs of movable, lamellar brake shoes. Each brake shoe is mounted in a jam-free manner on two pins for which it is fitted with appropriately large clearances. An electromagnet is mounted between the two pairs of brake shoes, and the armature of the electromagnet is fitted with a bridge resting against the outer brake shoes and which it presses against the inner ones.

Moreover, a yarn tensioner or yarn brake is known from the British patent A 20 93 488, such brake comprising two lamellar brake shoes enclosing the yarn to be braked. This yarn brake includes an electromagnet constituting two pole pieces. A first lamellar brake shoe made of a non-magnetic material rests against the two poles pieces. The second and outer brake shoe is made of a magnetizable material and can be pulled magnetically against the non-magnetizing brake shoe. The two lamellar brake shoes are substantially vertical and fitted onto two pins. The path of the yarn to be braked is horizontal and located substantially along the center of the two brake shoes.

The Swiss patent document A 68 21 48 discloses a yarn brake arranged to brake two yarns running parallel to each other each at two consecutive positions. The brake comprises three lamellar brake shoes, that is, one central brake shoe and two outer ones. The yarns run on each side of the central brake shoe and as a result can be braked in each case between the central and one outer brake shoe. The three brake shoes are held by an edge running parallel to the path of the yarn in a hook-shaped guide. One of the two outer brake shoes always rests against one wall of a support. The opposite outer brake shoe is adjustably spring-loaded and can be pressed against the central and the other outer brake shoe. The yarn path is between the brake shoe edges guided in a hook guide and a position where the loading force is applied.

SUMMARY OF THE INVENTION

The objective of this invention is to design a yarn brake of the above described type arranged so as to reduce the danger of damage and/or rupture to the yarn even when such yarn contains nubs, thin or thick parts or other irregularities.

This problem is solved by guiding the yarn along a path between the brake shoes and by positioning the movable lamellar brake shoe so that it projects beyond the fixed brake shoe in a transverse direction relative to the path of the yarn, and further by supporting the brake shoe at a location spaced at a distance away from the yarn path so that the shoe is tiltable about a tilt axis which runs substantially parallel to the yarn path.

The yarn brake of the invention allows the movable brake shoe to be tilted in a simple manner about a predetermined tilt axis when nubs or other yarn irregularities are moving between the brake shoes, as a result of which the yarn can move through the yarn brake without creating a sudden rise in braking force or without significant interference.

In an advantageous embodiment of the invention, the lamellar movable brake shoe is supported on two pins mounted substantially perpendicularly to the fixed brake shoe and spaced apart along the direction of motion of the yarn to be braked, where the first pin as seen in the direction of motion of the yarn to be braked is mounted on the side of the tilt axis facing the yarn path and the second pin is mounted on the side of the tilt axis facing away from said path, the movable lamellar brake shoe including clearances receiving the pins with play. In this embodiment, the tilt axis of the movable lamellar brake shoe is determined by the points of contact where the clearances of the lamellar brake shoe touch the pins. This embodiment is advantageous as regards the tilt of the movable brake shoe. In this embodiment the tilt axis is fixed, and as a result the torque exerted by the moving yarn on the movable brake shoe will also be reacted.

In this first embodiment, the tilt axis coincides with an edge of the fixed brake shoe, said edge running substantially parallel to the direction of motion of the yarn.

In another embodiment of the invention, the tilt axis coincides with an edge of a strip of a support enclosing the fixed brake shoe, and this edge extends substantially parallel to the direction of yarn motion. In both embodiments the movable lamellar brake shoe is pivoted about a defined tilt axis extending between the pins.

The edge defining the tilt axis outside the zone of the pins may be rectilinear. In an advantageous embodiment of the invention, the edge of the fixed brake shoe or the edge of a strip overlying the fixed brake shoe is convex when seen substantially perpendicularly to the braking surface of the brake shoes. This design simplifies tilting the movable brake shoe.

In a preferred embodiment, the brake shoes extend substantially vertically and the tilt axis extends substantially horizontally. This configuration is advantageous as regards tilting the movable brake shoe because the weight of the brake shoe has little effect on tilting and accordingly a comparatively heavy, movable brake shoe may be used. This feature is especially advantageous if the brake actuating devices use an electromagnet.

Preferably the actuating device of the magnetizable, lamellar movable brake shoe comprise a spring with preferably adjustable loading features and a switchable electromagnet. In another preferred embodimentof the invention, the electromagnet comprises two pole pieces which are located at one side of the fixed brake shoe and on either side of the path of the yarn. Appropriately, one of the pole pieces of the electromagnet is mounted approximately in the vicinity of the tilt axis. This feature has the advantage that the movable brake shoe can still tilt about the tilt axis even when actuated by the electromagnet.

In another preferred embodiment of the invention, the fixed brake shoe and/or the movable brake shoe are configured to provide beveled intake zones for the yarn to be braked. This feature provides an advantage for the yarn's transit through the yarn brake.

In a further embodiment of the invention, the tilt axis when viewed in topview subtends an angle with the yarn path that converges in the direction of the yarn path. A thickening of an incoming yarn is then able to fairly easily tilt the movable brake shoe.

BRIEF DESCRIPTION OF THE DRAWINGS

Further features and advantages of the invention will be evident from in the following description of the illustrative embodiments shown in the drawings.

DETAILED DESCRIPTION OF THE PREFERRED EMBODIMENTS

Figure 1:
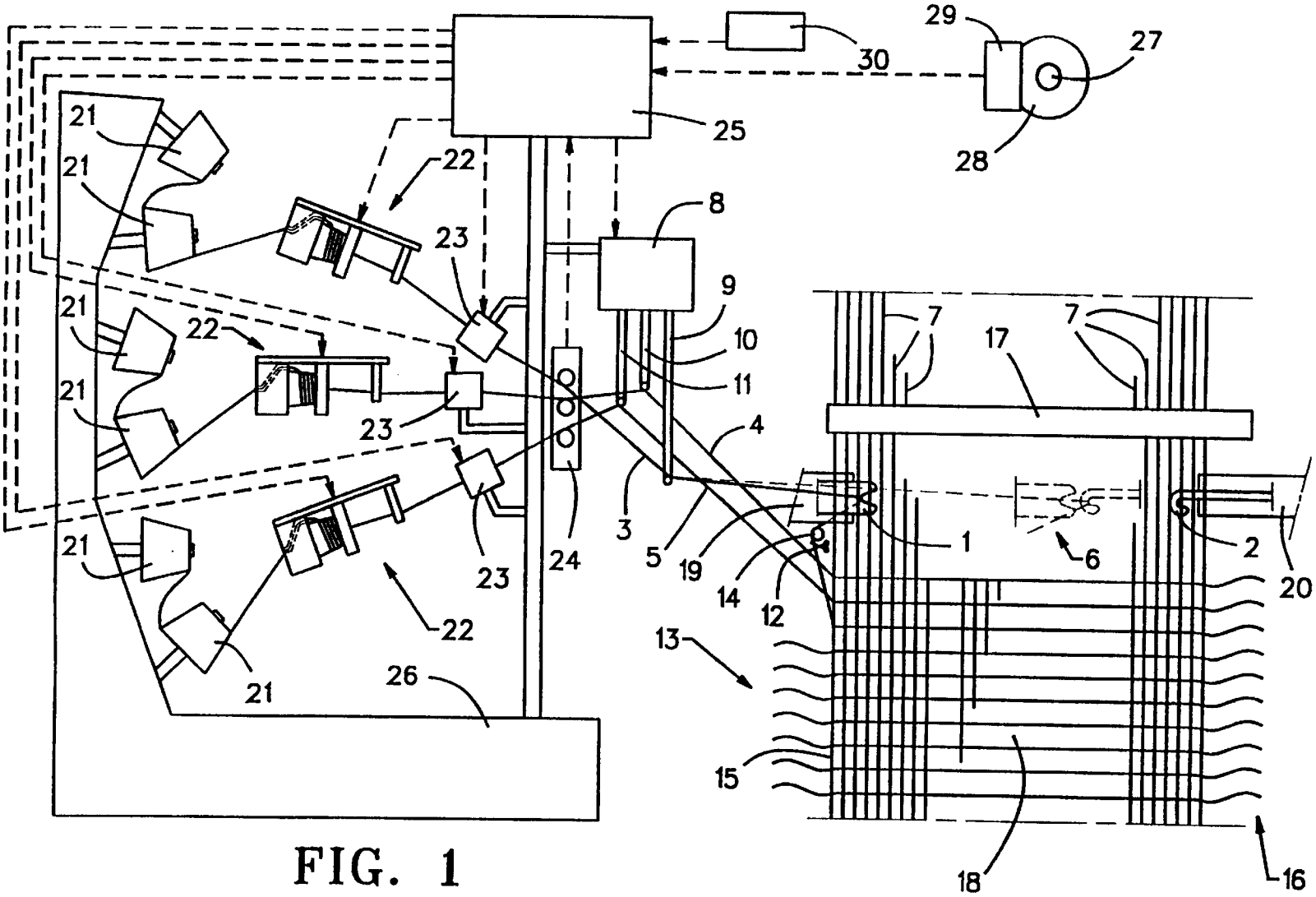
FIG. 1 diagrammatically shows a gripper weaving machine comprising several yarn brakes.
Figure 2:
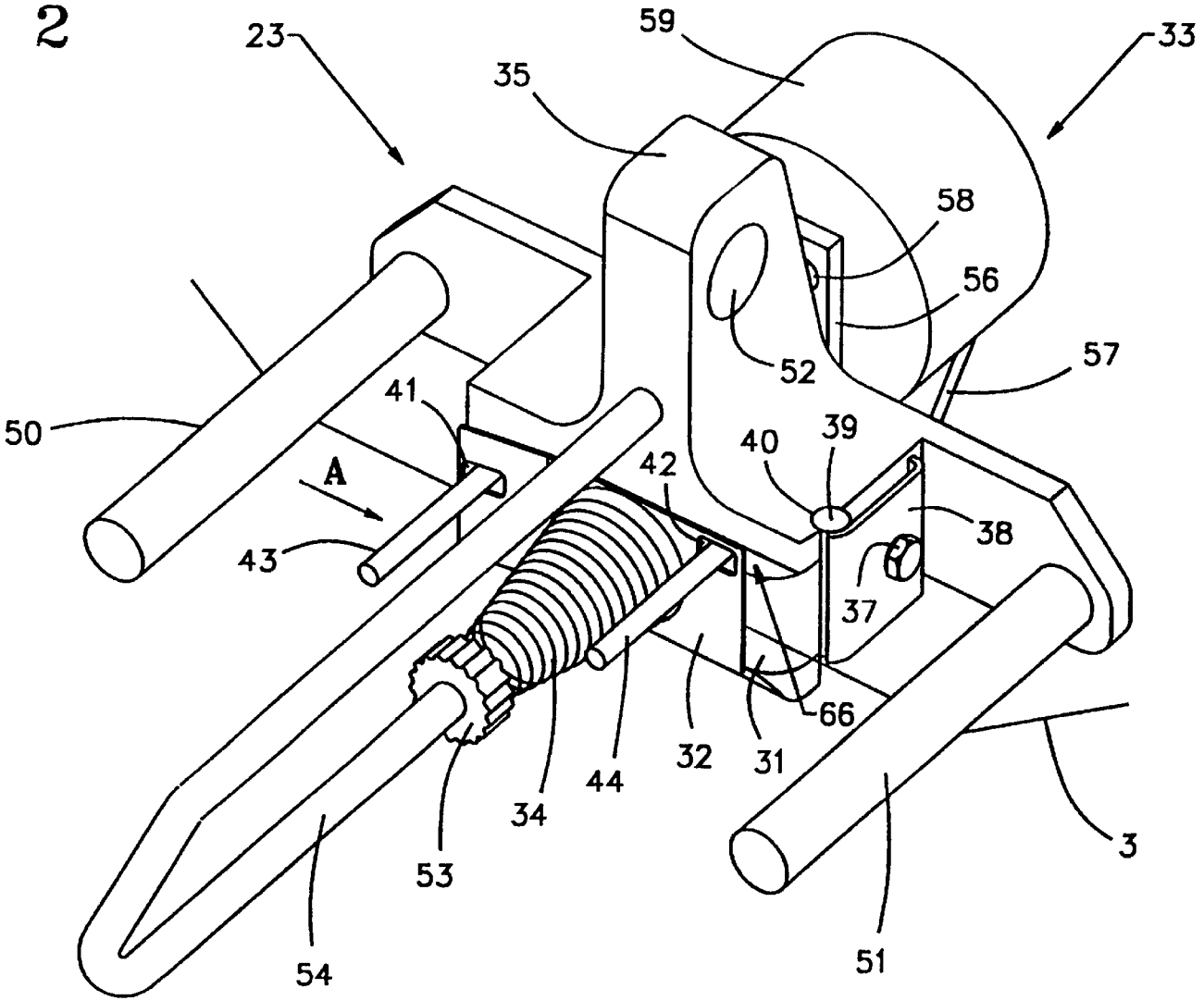
FIG. 2 is a perspective on a larger scale of a yarn brake of the invention.

The gripper weaving machine shown in FIG. 1 comprises a feed gripper 1 and a receiving gripper 2 which move fillings 3, 4, 5 into a shed 6. The shed is formed of warps 7 that are raised and lowered by a shed forming device (not shown). The fillings are fed by needles 9, 10, 11 of a yarn feed system 8 to the feed gripper 1, transferred to the gripper, then severed by filling scissors 12 at guide 14 on the intake side 13, in the vicinity of the selvage 15. Thereafter the fillings are moved by the feed gripper 1 as far as approximately the center of the shed 6. The receiving gripper 2 moves substantially in synchronization with the feed gripper 1 from the opposite side 16 into the shed 6 and then back out of it again. Substantially at the middle of the shed 6, a respective filling is removed by the receiving gripper 2 from the feed gripper 1 and moved by the receiving gripper 2 to the opposite side 16 of the shed 6. Thereupon the filling is released at said side 16 from the receiving gripper and beaten by the batten 17 against the fabric 18 whereafter they are bound by the warp threads. The feed gripper 1 and the receiving gripper 2 are mounted respectively to driven rapiers 19 and 20 which move them into and back out of the shed 6.

The filling yarns 3, 4, 5 run from spools 21 over filling preparers 22, through the yarn brakes 23, stop motions 24 and needles 9, 10, 11, to the insertion side 13. A control unit 25 controls the preparers 22, the yarn brakes 23 and the needles 9, 10, 11 of the yarn feed system. This control unit also receives yarn-rupture signals from the stop motions 24. The yarn brakes 23, the yarn feed system 8, the control unit 25, the stop motion 24 and the spools 21 are mounted on one machine frame. The preparers 22 furthermore are affixed by supports (not shown) to said frame.

FIG. 1 also shows a shaft 27 rotating synchronously with the main drive shaft of the weaving machine. An encoder disk 28 is provided on this shaft 27 to determine its angular position and cooperates with a sensor 29 connected to the control unit 25. The sensor 29 feeds signals representing the angular position of the shaft 27 to the control unit. Moreover a data input system 30 controlling the yarn brakes 23 is connected to the control unit 25 in order to also control the yarn brakes as a function of the angular position of the shaft 27 and hence synchronously with the operation of the weaving machine and/or of the state of the motion of the filling inserted into a shed 6. Such a control is known for instance from U.S. Pat. No. 5,002,098 and therefore need not be discussed further herein.

The yarn brakes 23 according to the present invention are shown in FIGS. 2 through 7. A yarn brake 23 includes two brake shoes 31, 32 arranged to brake a filling 3 located between them. One brake shoe 31 is fixed, while the other brake shoe 32 is movable. The brake shoes 31, 32 are made of a wear-resistant material or include a wear-resistant coating at least in the zone wherein they make contact with the filling 3. The yarn brake 23 furthermore includes actuating devices to compress the brake shoes 31, 32 against each other. These actuating devices comprise of an electromagnet 33 and a spring 34 which both urge the movable brake shoe 32 toward the fixed brake shoe 31. In the embodiment shown, the brake shoes 31, 32 are arranged substantially vertical.

The fixed brake shoe 31 is a thin, flexible sheet or lamellar for instance made of a steel which is non or only slightly magnetizable and which is firmly affixed to a support 35. The support is made of non-magnetizable material, for example aluminum casting. In the region of its two ends, the fixed brake shoe 31 includes apertures 36 and accordingly can be affixed by screws 37 to the support 35. A tightening element 38 is provided to assure that the fixed brake shoe makes full surface contact with a mating surface of the support 35. By means of a rod 39, for example, made of rubber, the tightening element 38 forces the lamellar brake shoe 31 into a recess 40 of the support 35. Obviously, the brake shoe 31 may be affixed in a different manner to the support 35, for instance by being bonded to it.

Figure 4:
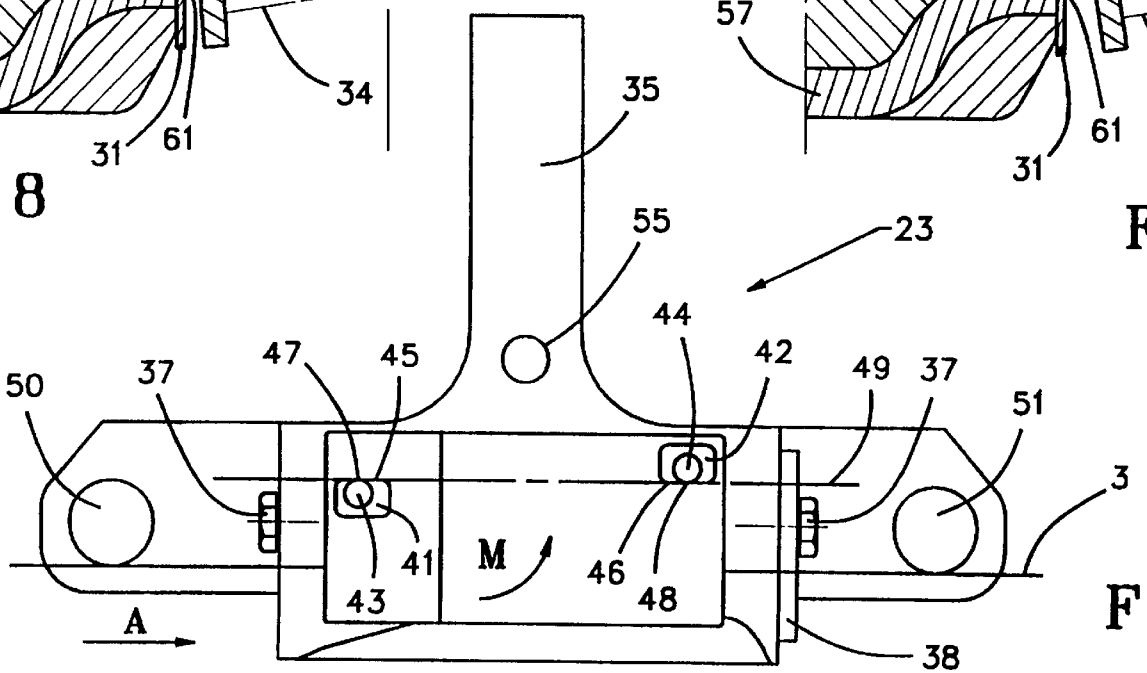
FIG. 4 is a front view of the yarn brake of the invention of FIGS. 2 and 3 (without a spring loading device)
Figure 5:
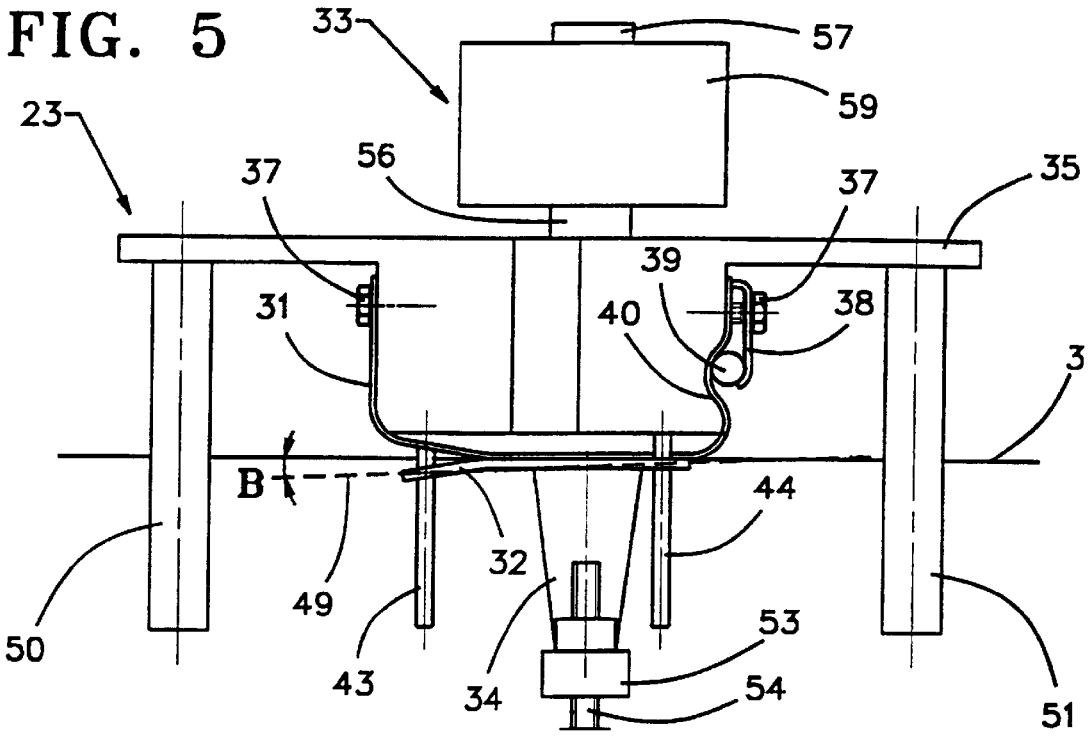
FIG. 5 is a topview of the yarn brake of FIGS. 2 through 4.

The movable brake shoe 32 also is a lamellar metal sheet and of a thickness of about 1 mm or less. The brake shoe 32 comprises two clearances 41, 42 which are separated along the direction of motion A of the filling 3 to be braked. These clearances 41, 42 also are located at different distances away from the path of the filling 3 to be braked. The reason for this is discussed further below. The support 35 is fitted with two pins 43, 44. The pins 43, 44, for example made of ceramic, are rigidly affixed in the support 35, for instance by being glued into boreholes in this support 35. The pins 43, 44 run substantially perpendicularly to the brake shoes 31, 32 and are received with comparatively large play by the cross-sectionally rectangular clearances 41, 42. The pins 43, 44 also are mounted at different distances from the path of the filling 3 to be braked. As shown in FIG. 4, the clearance 41 is defined by an edge 45 resting against the pin 43 at a contact point 47. The clearance 42 also is defined by an edge 46 resting against the pin 44 at a contact point 48. A line between contact points 47, 48 defines a tilt axis 49 about which the lamellar brake shoe 32 may be tilted. As shown by FIG. 4, the edges 45, 46 of the preferred embodiment of the invention are substantially coplanar and they essentially are colinearwith the tilt axis 49.

A filling 3 braked by a shoe brake 32 exerts a torque M on the lamellar brake shoe in the direction shown in FIG. 4. The lamellar brake shoe 32 is rotated thereby in such manner that the edge 45 of the clearance 41 rests against the pin 43 at the contact point 47 and the edge 46 of the clearance 42 rests against the pin 44 at the contact point 48. Because of this torque M, the pin 43 is mounted on the side of the tilt axis 49 facing toward the path of the filling 3, whereas the pin 44 is mounted on that side of the tilt axis 49 facing away from the path of the filling 3. For this reason the two clearances 41 and 42 also are configured correspondingly, that is, the clearance 41 is closer to the path of the filling 3 than is the clearance 42.

The tilt axis 49, determined by the contact points 47, 48 of the movable lamellar brake shoe 32 at the pins 43, 44, is located a distance from the path of the filling 3 to be braked. The tilt axis 49 extends nearly parallel to direction of motion A of the filling. The illustrated embodiment shows that the tilt axis 49 as depicted in FIG. 4 runs substantially parallel to the path of the filling 3 and, according to the topview of FIG. 5, subtends a relatively slight angle B relative to the filling 3. This relatively slight angle B offers the advantage that the filling 3 is able to tilt the lamellar brake shoe 32 about its tilt axis. In the shown embodiment, the tilt axis 49 extends substantially horizontally.

In the illustrated embodiment, the path of the filling 3 is determined by two yarn guides 50, 51 which, in a way not shown in further detail, are affixed for instance by screws to the support 35. The support 35 also comprises an aperture 52 by which it can be affixed with, for example, a rod-like retention means to the framework 26.

The spring 34 is in the form of an externally frustoconical helical spring that rests on one side against an adjustment nut 53 and on the other side against the lamellar brake shoe 32. The adjustment nut 53 is screwed onto a threaded spindle 54 which is approximately U-shaped and is affixed to the support 35. Illustratively, it may be glued into a borehole 55 of the support 35. By adjusting the adjustment screw 53, it is possible to select the mechanical bias of the spring 34 and thereby its actuating force. As shown especially in FIGS. 7 and 8, the movable lamellar brake shoe 32 projects laterally beyond the fixed brake shoe 31 on the side facing away from the tilt axis 49 and in a direction transversely of the yarn path. The spring 34 is is mounted and oriented in such a way that its axis and hence the focus or point of its loading application is directed to a zone between the path of the filling 3 and the tilt axis 49.

Figure 3:
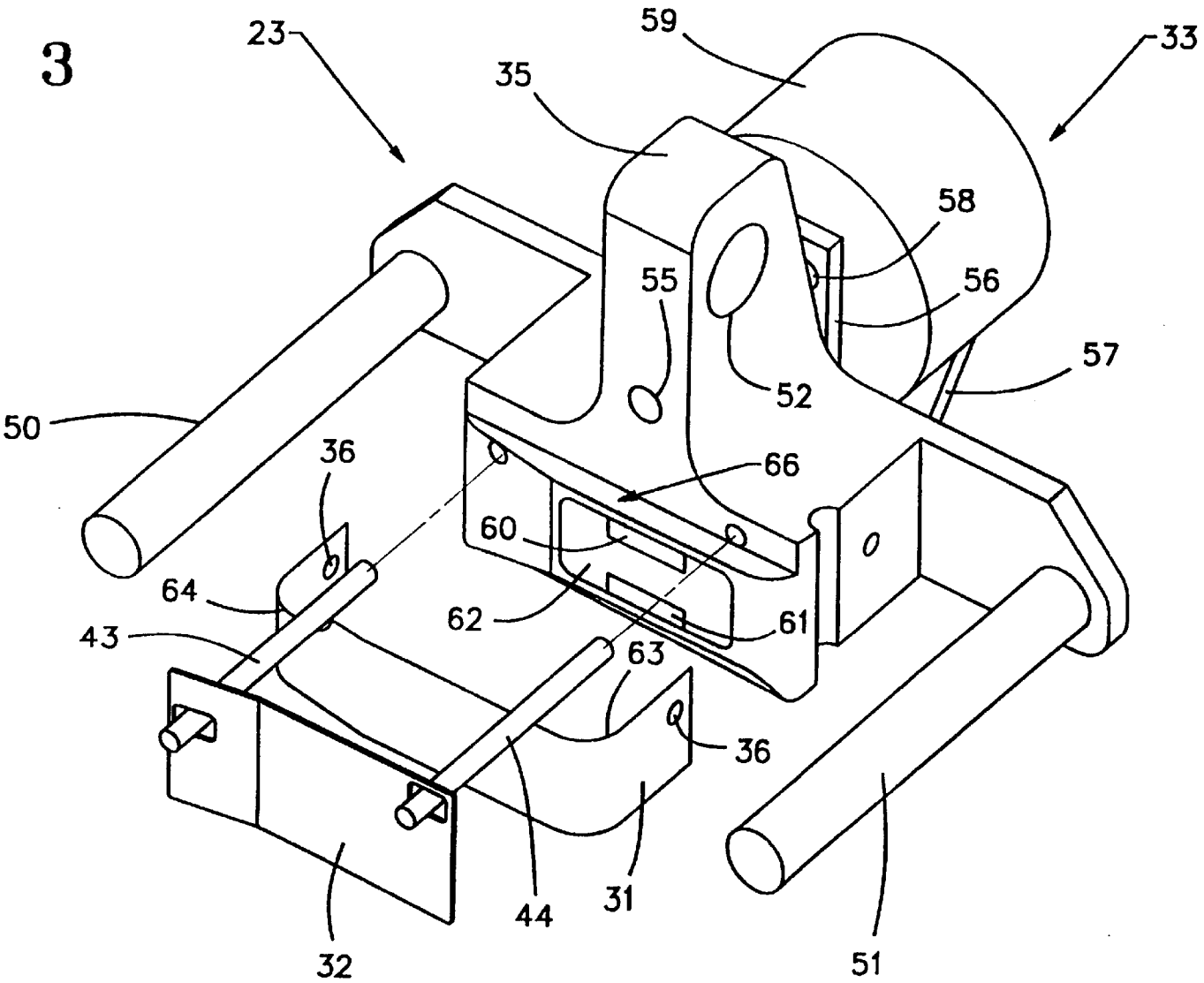
FIG. 3 is an exploded view of the yarn brake of FIG. 2 (without the spring-loading device)
Figure 6:
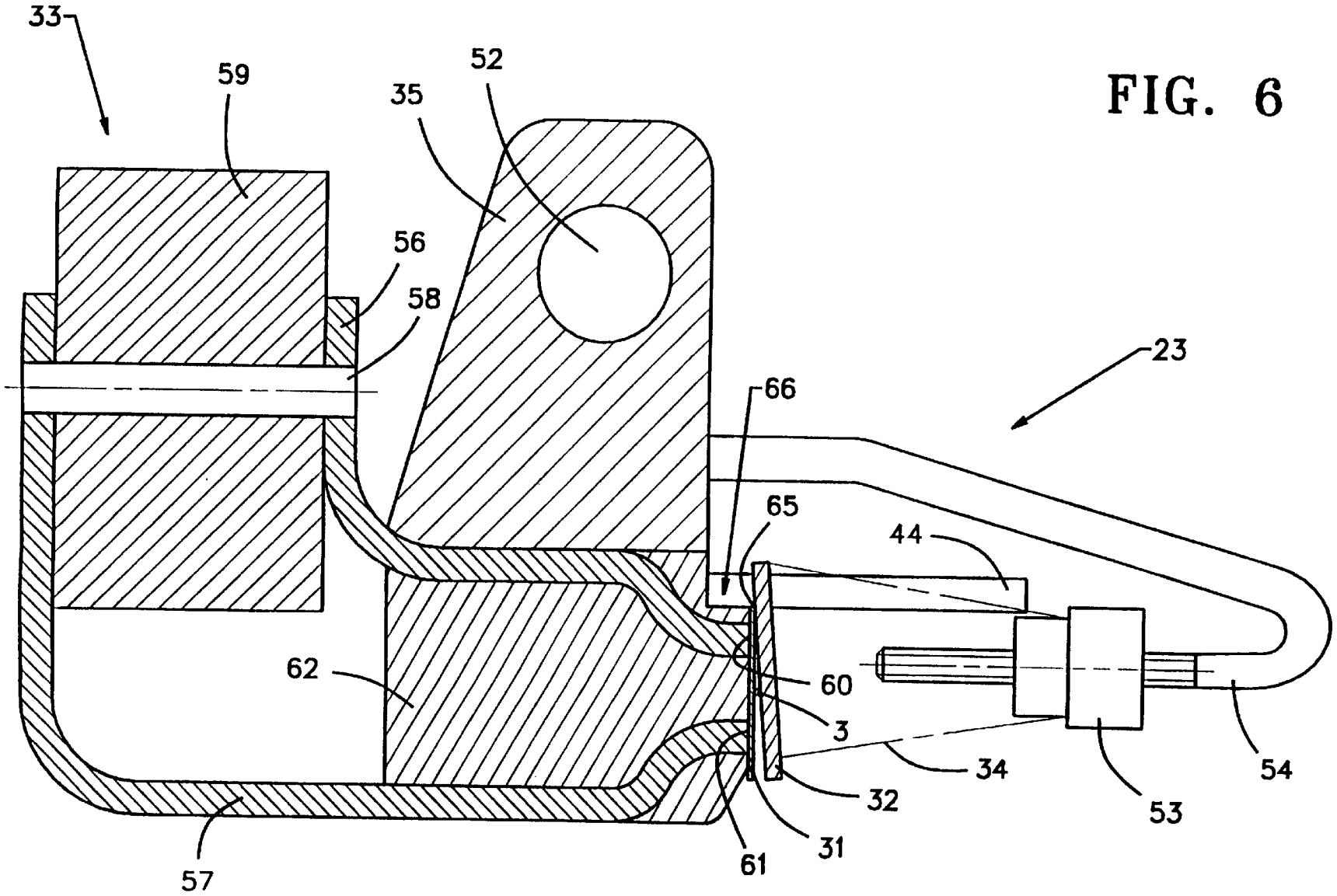
FIG. 6 is a partly sectional view of the yarn brake of FIGS. 2 through 5.

As shown in particular by FIG. 6, the electromagnet 33 contains two curved iron bars 56, 57 having ends outside the support 35 connected by an iron bar 58. The iron bar 58 is provided with a coil 59. The other ends of the iron bars 56, 57 terminate at pole pieces 60, 61 located at the fixed brake shoe 31. These pole pieces 60, 61 are configured in such manner that the path of the filling 3 to be braked will lie between them. As shown by FIGS. 3 and 6, the support 35 comprises a cavity 62 receiving the iron bars 56 and 57 and the pole pieces 60, 61. This cavity 62 is filled with non-conducting material, and as a result both the iron bars 56, 57 and also the iron bar 58 and the coil 59 are secured in place. The coil 59 can be energized by the control unit 25 at specific times with a specified current to generate an appropriate force to pull the movable lamellar brake shoe 32 against the pole pieces 60, 61.

The electromagnet 33 represents only one illustrative embodiment. Any kind of coil and/or core may be used as an electromagnet which could generate a sufficient magnetic field in the vicinity of the pole pieces 60, 61 to pull the brake shoe 32 against the brake shoe 31.

Figure 7:
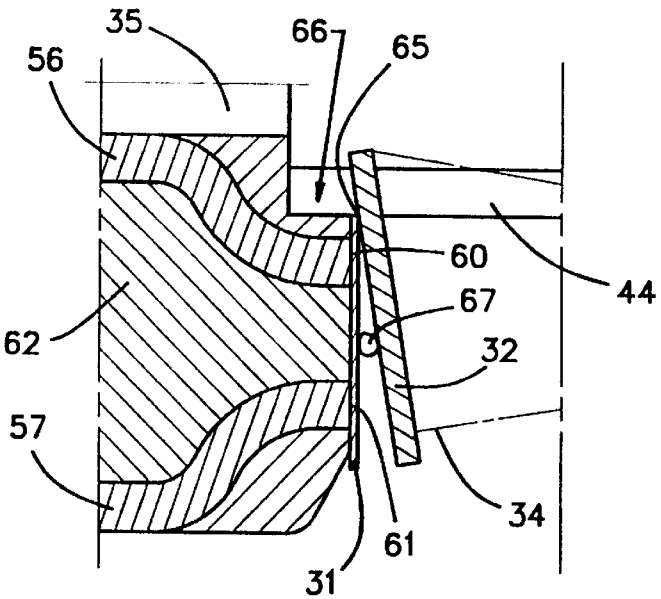
FIG. 7 is a partly sectional view corresponding to FIG. 6 on a larger scale with a yarn thickening in transit.

As shown in FIG. 3, the fixed brake shoe 31 assumes an approximate U shape. In its installed position, its upper edge 63 is fitted with clearance 64 in the region of the pin 43, whereby the edge 63 runs tangentially to the top side of the pin 43, that is, to the point of contact 47 with the edge 45 of the clearance 41 of the lamellar brake shoe 32. The fixed brake shoe 31 furthermore is mounted in such a way that its edge 63 runs tangentially to the underside of the pin 44, that is, to the point of contact 48 between the edge 46 of the clearance 42 of the movable brake shoe 32. The segment 65 of the edge 63 located between the pins 43 and 44 thereby substantially coincides with the tilt axis 49. As a result, the segment 65 supports the movable brake shoe 32 when the latter tilts about its tilt axis 49, as shown in FIGS. 6 and 7. As shown clearly in FIG. 3, the pole piece 60 of the electromagnet 33 is mounted in the vicinity of the segment 65 and thus near the tilt axis 49.

In the illustrated embodiment, the surface of the movable brake shoe 32 opposite the fixed brake shoe 31 is substantially planar along the segment that is attracted by the pole pieces 60, 61 of the electromagnet and subjected to the force of the spring 34. The incoming zone for the filling 3 of the movable lamellar brake shoe 32, that is the region facing the yarn guide 50, curves away from the fixed brake shoe 31 and as a result a tapered intake has been created for the filling 3.

During weaving, the movable brake shoe 32 is biased by the spring 34 toward the fixed brake shoe 31, so that the filling 3 will be braked between the brake shoes 31 and 32. The spring 34 is relatively weak and consequently the braking force applied by the spring 34 also is relatively slight. This braking force can be adjusted by rotating the adjustment nut 53 on the threaded spindle 54. If a higher braking force is required during the insertion of a filling, the electromagnet 33 shall be so controlled that the movable brake shoe 32 is attracted by the pole pieces 60 and 61. Thereupon the filling 3 is clamped harder between the fixed brake shoe 31 and the movable brake shoe 32. Because the fixed brake shoe 31 is made of a non-magnetic material, or one which magnetizes only slightly, the movable brake shoe 32 can be attracted with a comparatively high force by the electromagnet 33.

If, as illustratively shown in FIG. 6, the filling 3 is between the fixed brake shoe 31 and the movable brake shoe 32, the latter assumes a position wherein it rests on the segment 65 of the edge 63 of the fixed brake shoe 31. This tilting displacement is feasible because a free space 66 is left above the fixed brake shoe 31 in the support 35. The movable brake shoe 32 therefore tilts easily about the tilt axis 49 and/or about the segment 65 of the edge 63 of the fixed brake shoe 31. If now—as shown in FIG. 7—a thickening 67 of the filling 3 moves through the yarn brake 23, then this thickening 67 further tilts the movable brake shoe 32 away from the fixed brake shoe, whereby the movable brake shoe 32 tilts about the tilt axis 49 substantially coinciding with the segment 65. The pins 43, 44 do not hamper this tilting motion of the movable brake shoe 32 because the clearances 41, 42 as seen in a direction transverse to the yarn direction A have a comparatively large play relative to the pins 43, 44. Because filling 3 exerts a torque M on the movable brake shoe 32 to bring about braking between the brake shoes 31, 32, the edges 45 and 46 of the clearances 41 and 42 are pressed against the respective pins 43 and 44. As a result the apertures 41,42 may be relatively large with respect to the pins 43,44 without the movable brake shoe 32 rotating as a result about a horizontal axis during operation. Therefore the tilt axis 49 remains established during weaving by the line connecting the contact point 47 of the pin 43 at the edge 45 of the clearance 41 to the contact point 48 of the pin 44 at the edge 46 of the clearance 42.

Figure 8:
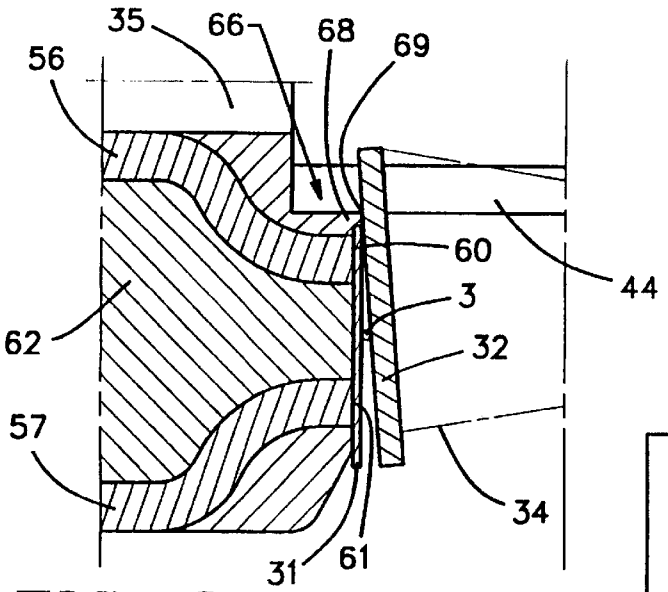
FIG. 8 is a partly sectional view corresponding to FIG. 7 of another embodiment with the yarn passing through the yarn brake.

As regards the embodiment of FIG. 8, the support 35 is fitted an edge forming element 68 overlying the upper edge of the fixed brake shoe 31. This element 68 extends in the manner of the above described segment 65 of the upper edge 63 of the fixed brake shoe 31. The element 68 therefore forms an upper edge 69 substantially coinciding with the tilt axis 49, and the movable brake shoe 32 rests on this edge 69. Using such an element offers the advantage that the fixed brake shoe 31 need not necessarily be mounted in a precise edge defining position.

Figure 9:
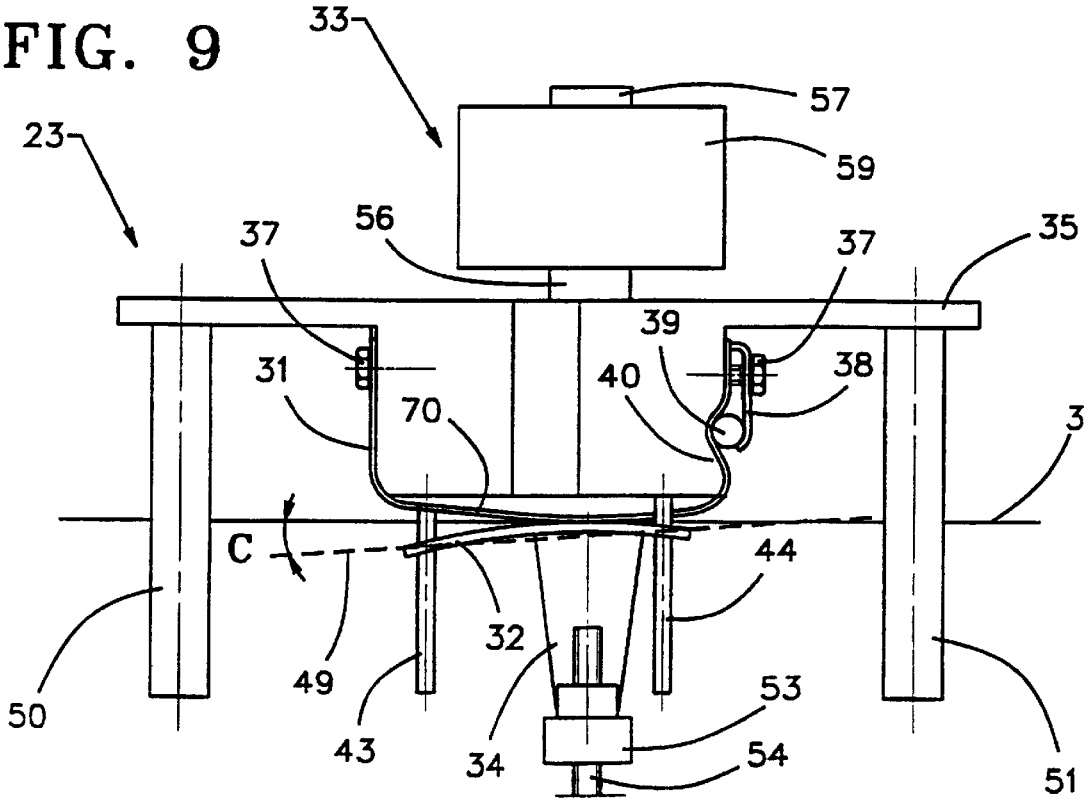
FIG. 9 is a topview similar to that of FIG. 5 of another embodiment of a yarn brake.

As regards the embodiment of FIG. 9, the surface of the movable brake shoe 32 facing the fixed brake shoe 31 is slightly convex. This surface is curved at least on the incoming side facing the yarn guide 50, that is where the filling to be braked first comes into contact with the brake element 32 when it is located away from the fixed brake shoe 31. The surface of the fixed brake shoe 31 facing the movable brake shoe 32 also is slightly convex. The upper edge 70 of the fixed brake shoe 31 therefore is also sightly convex in the zone between the pins 43, 44. This feature is advantageous when tilting the movable brake shoe 32 because it rests only over a short distance against the edge 70 and consequently tilting the brake shoe 32 can be carried out against comparatively slight resistance. In this embodiment as well, the tilt axis 49 is so determined by the pins 43, 44 that it shall run substantially parallel to the filling 3 to be braked. In the topview of FIG. 9, the tilt axis 49 subtends a slight angle C with the filling 3 to be braked, whereby the whole the tilt axis 49 runs substantially parallel to the filling 3 to be braked and therefore the brake shoe 32 can be tilted in a simple manner.

The path of the filling 3 to be braked need not be determined by the two yarn guides 50, 51 mounted on the support 35 of the yarn brake 23. The function of the first yarn guide 50 can be assumed by a yarn guide at the outlet of the preparation system 22 and the function of the second yarn guide 51 can be assumed by a yarn guide of the stop motion 24. In this case the distance between the preparation system 22 and the yarn brake 23 and the distance between the yarn brake 23 and the stop motion 24 should be comparatively small.

Other embodiments of yarn guides, for instance in the form of yarn eyes, may be used instead of the rod-shaped yarn guides 50, 51.

The yarn brake 23 was described above only with respect to the filling 3. Obviously the yarn brakes 23 may also be designed the same way for the fillings 4 and 5.

Obviously too, the above-described and illustrated yarn brake for decelerating the fillings 3, 4, 5 of a gripper weaving machine also may be used to brake fillings in other types of weaving machines, for instance airjet, water-jet, projectile, or various other types of weaving machines. Furthermore the yarn brake 23 also may be used to brake yarns in other kinds of textile machinery, for instance spoolers, beamers, knitting machines, or other types of machinery wherein a yarn must be braked.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

What is claimed is:

1. A yarn brake comprising:

a fixed brake shoe;

an actuating device; and a movable lamellar brake shoe which can be actuated by the actuating device and pressed against the fixed brake shoe, the movable lamellar brake shoe is adapted to brake a yarn running and guidable along a path between the brake shoes, the movable lamellar brake shoe projects beyond the fixed brake shoe in a direction transversely of the path of the yarn, and the movable lamellar brake shoe is supported for rotation at a distance spaced from the path of the yarn about a tilt axis running substantially parallel to the path of the yarn.

2. The yarn brake as claimed in claim 1, wherein the movable lamellar brake shoe is held in place by two pins which are mounted substantially perpendicularly to the fixed brake shoe and are mutually spaced apart in a direction of motion of the yarn to be braked, the first pin as observed relative to the direction of motion of the yarn is mounted on the side of the tilt axis facing the path of the yarn and the second pin as observed relative to the direction of motion of the yarn is mounted on the side of the tilt axis facing away from the path of the yarn, and the movable lamellar brake shoe includes clearances that receive the pins with play.

3. The yarn brake as claimed in claim 2, wherein the clearances include straight edges extending in the direction of the tilt axis.

4. The yarn brake as claimed in claim 1, wherein the tilt axis coincides with an edge of the fixed brake shoe, the edge of the fixed brake shoe extends substantially parallel to a direction of motion of the yarn.

5. The yarn brake as claimed in claim 1, wherein the tilt axis coincides with an edge of an edge forming element located on a support and overlying the fixed brake shoe, said edge of an edge forming element running substantially parallel to a direction of motion of the yarn.

6. The yarn brake as claimed in claim 4, wherein the tilt axis coincides with an edge of an edge forming element, the edge of the fixed brake shoe or an edge of the edge forming element overlying the fixed brake shoe, said edges are rectilinear or are substantially convex perpendicularly to a braking surface of the fixed brake shoe.

7. The yarn brake as claimed in claim 1, wherein the brake shoes are arranged substantially vertically and the tilt axis extends substantially horizontally.

8. The yarn brake as claimed in claim 1, wherein the movable lamellar brake shoe is magnetizable and the actuating device comprises a spring that provides adjustable brake loading and a switchable electromagnet.

9. The yarn brake as claimed in claim 8, wherein the electromagnet comprises two pole pieces respectively located on either side of the path of the yarn and near one side of the fixed brake shoe.

10. The yarn brake as claimed in claim 9, wherein the electromagnet includes a one pole piece that is mounted at least approximately in the vicinity of the tilt axis.

11. The yarn brake as claimed in claim 1, wherein the fixed brake shoe and/or the movable brake shoe have a tapered area forming an intake zone for a yarn to be braked.

12. The yarn brake as claimed in claim 1, wherein the tilt axis subtends an angle converging in a direction of yarn motion with the path of the yarn.

* * * * *